US007992657B2

(12) United States Patent
Peterson

(10) Patent No.: US 7,992,657 B2
(45) Date of Patent: Aug. 9, 2011

(54) EARTH BIT HAVING A WEAR RING

(75) Inventor: Gregory W. Peterson, Fort Worth, TX (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 248 days.

(21) Appl. No.: 11/840,886

(22) Filed: Aug. 17, 2007

(65) Prior Publication Data

US 2008/0041634 A1 Feb. 21, 2008

Related U.S. Application Data

(60) Provisional application No. 60/822,899, filed on Aug. 18, 2006.

(51) Int. Cl.
*E21B 10/08* (2006.01)
*E21B 10/46* (2006.01)
*F16C 33/72* (2006.01)

(52) U.S. Cl. ..... 175/371; 175/372; 384/94

(58) Field of Classification Search ..... 175/371, 175/372; 384/94
See application file for complete search history.

(56) References Cited

U.S. PATENT DOCUMENTS

| | | | | |
|---|---|---|---|---|
| 3,550,972 | A | | 12/1970 | Coski |
| 3,746,405 | A | | 7/1973 | Welton |
| 3,847,235 | A | | 11/1974 | Goodfellow |
| 4,040,493 | A | | 8/1977 | Saxman |
| 4,136,748 | A | | 1/1979 | Dickerhoff |
| 4,190,301 | A | | 2/1980 | Lachonius et al. |
| 4,303,137 | A | | 12/1981 | Fischer |
| 4,427,307 | A | | 1/1984 | Norlander et al. |
| 4,613,004 | A | | 9/1986 | Shotwell |
| 4,627,882 | A | | 12/1986 | Soderstrom |
| 4,666,001 | A | | 5/1987 | Burr |
| 4,671,368 | A | | 6/1987 | Burr |
| 4,688,651 | A | | 8/1987 | Dysart |
| 4,722,404 | A | * | 2/1988 | Evans ..... 175/371 |
| 4,741,471 | A | | 5/1988 | Sullivan |
| 4,762,189 | A | | 8/1988 | Tatum |
| 4,781,770 | A | | 11/1988 | Kar |
| 5,005,989 | A | | 4/1991 | Karlsson |
| 5,009,519 | A | | 4/1991 | Tatum |
| 5,080,183 | A | | 1/1992 | Schumacher et al. |
| 5,137,097 | A | | 8/1992 | Fernandez |
| 5,513,715 | A | | 5/1996 | Dysart |
| 5,570,750 | A | | 11/1996 | Williams |
| 5,586,611 | A | * | 12/1996 | Dorosz ..... 175/369 |
| 5,740,871 | A | | 4/1998 | Williams |
| 5,875,861 | A | | 3/1999 | Daly et al. |
| 6,026,917 | A | * | 2/2000 | Zahradnik et al. ..... 175/371 |
| 6,033,117 | A | * | 3/2000 | Cariveau et al. ..... 384/94 |
| 6,176,330 | B1 | | 1/2001 | Burr |

(Continued)

FOREIGN PATENT DOCUMENTS

FR 2 300 931 9/1976

(Continued)

*Primary Examiner* — Kenneth L Thompson
*Assistant Examiner* — Catherine Loikith
(74) *Attorney, Agent, or Firm* — Schmeiser Olsen & Watts LLP

(57) ABSTRACT

An earth bit includes a cutting cone rotatably mounted to a lug with a journal. A sealing member is sealingly engaged with the cutting cone and a wear ring carried by the lug. The wear ring is dynamically engaged with the first sealing member and statically engaged with the lug.

39 Claims, 6 Drawing Sheets

U.S. PATENT DOCUMENTS

| | | | | |
|---|---|---|---|---|
| 6,254,275 | B1 | 7/2001 | Slaughter, Jr. et al. | |
| 6,336,512 | B1 | 1/2002 | Siracki et al. | |
| 6,427,790 | B1 | 8/2002 | Burr | |
| 6,431,293 | B1 | 8/2002 | Portwood et al. | |
| 6,460,635 | B1 | 10/2002 | Kalsi et al. | |
| 6,513,607 | B2 | 2/2003 | Peterson et al. | |
| 6,679,342 | B2 | 1/2004 | Portwood et al. | |
| 6,695,079 | B2 | 2/2004 | Portwood et al. | |
| 7,392,862 | B2 * | 7/2008 | Zahradnik et al. | 175/371 |
| 2005/0023042 | A1 | 2/2005 | Yong et al. | |
| 2005/0274549 | A1 | 12/2005 | Yong et al. | |

FOREIGN PATENT DOCUMENTS

| | | | |
|---|---|---|---|
| GB | 2019921 | A | 11/1979 |
| GB | 2045315 | A | 10/1980 |
| GB | 2045838 | A | 11/1980 |
| SU | 574515 | | 9/1977 |
| SU | 641062 | | 1/1979 |

* cited by examiner

EARTH BIT HAVING A WEAR RING

CROSS-REFERENCE TO RELATED APPLICATIONS

This patent application claims priority to U.S. Provisional Application No. 60/822,899 filed in Aug. 18, 2006, the contents of which are incorporated herein by reference.

BACKGROUND OF THE INVENTION

1. Field of the Invention

This invention relates generally to earthboring tools for boring a hole.

2. Description of the Related Art

Earthboring tools are commonly used to bore holes by cutting through earthen annulus. Such holes may be bored for many different reasons, such as drilling for oil, minerals and water. One type of earthboring tool used for boring is a rotary earth bit. Several examples of rotary earth bits are disclosed in U.S. Pat. Nos. 3,550,972, 3,847,235, 4,136,748, 4,427,307, 4,688,651, 4,741,471 and 6,513,607. A rotary earth bit generally includes an earth bit body comprised of three lugs. A cutting cone is rotatably mounted to each lug with a journal. The journal generally includes ball and roller bearings which engage the cutting cone. The lug rotates in response to the rotation of the earth bit. The cutting cones are engaged with the roller and ball bearings and rotate about the journal in response to contacting earthen annulus.

It is known that earthboring tools wear down with use. For example, the portion of the earth bit proximate to the interface between the lug and cutting cone experiences a significant amount of wear and will cause early failure if it wears too much. Replacing an earth bit is costly and time consuming, so it is desirable to decrease the amount of wear the earth bit experiences.

BRIEF SUMMARY OF THE INVENTION

The present invention provides a wear ring for use with an earth bit. The earth bit includes a cutting cone rotatably mounted to a lug with a journal. A sealing member is carried by and rotates with the cutting cone. Further, the wear ring extends around the journal and is engaged with the sealing member. The sealing member is statically engaged with the cutting cone and dynamically engaged with the wear ring, and the wear ring is dynamically engaged with the sealing member and statically or dynamically engaged with the lug.

The wear ring reduces the amount of wear the sealing member experiences when it rotates relative to the lug. For example, the wear ring and sealing member restrict the flow of abrasive material to the journal and cutting cone. Further, the wear ring includes a smooth surface which engages the sealing member so there is less friction between them. The wear ring includes a material which is more abrasion resistant than the material included with the lug. In this way, the sealing member experiences less wear because it engages the wear ring instead of the lug. These features are useful because abrasive material and friction can wear the sealing member and/or its mating surface.

In some embodiments, the wear ring engages the cutting cone and lug because the earth bit does not include a sealing member. The wear ring operates as a sealing member and reduces the amount of wear experienced by the cutting cone and lug because it includes a more abrasion resistant material.

Further features and advantages of the invention will be apparent to those skilled in the art from the following detailed description, taken together with the accompanying drawings.

DETAILED DESCRIPTION OF THE INVENTION

Figure 1:
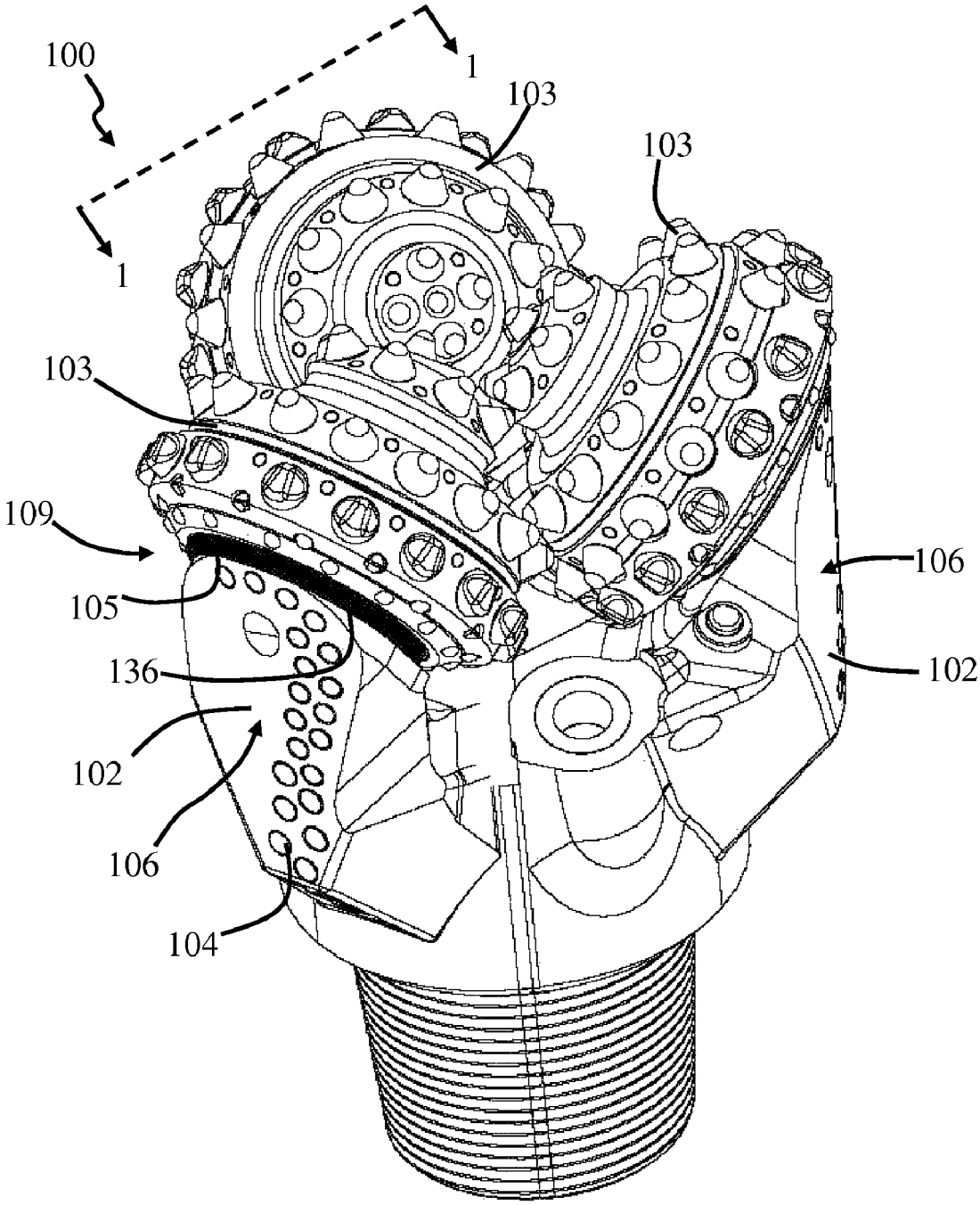
FIG. 1 is a perspective view of an earth bit having a wear ring, in accordance with the invention.
Figure 2A:
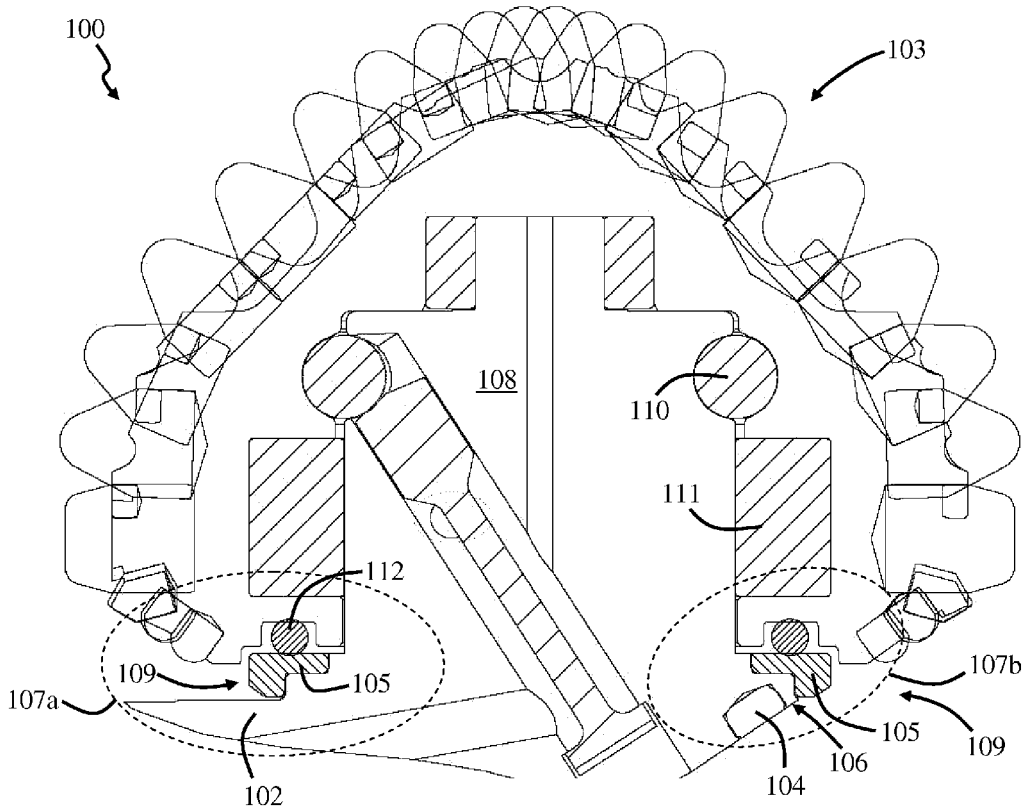
FIG. 2*a* is a cut-away view of the earth bit of FIG. 1 taken along a cut-line 1-1 and showing a cutting cone rotatably mounted to a lug with a journal.
Figure 2B:
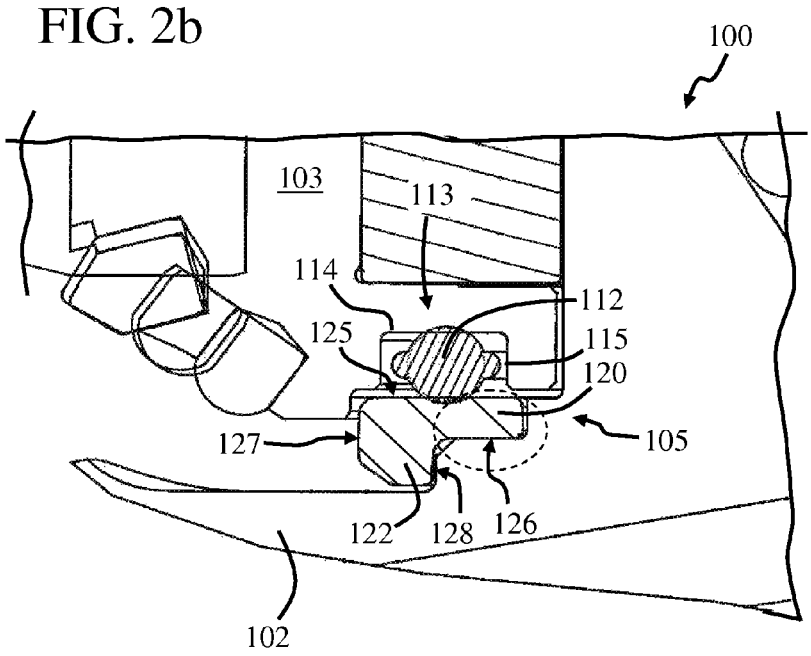
FIG. 2*b* is a close-up view of the cutting cone and journal of FIG. 2*a* with a wear ring having an upwardly extending lip, in accordance with the invention.

FIG. 1 is a perspective view of an earth bit 100, in accordance with the invention, and FIG. 2*a* is a cut-away side view of earth bit 100 taken along a cut-line 1-1 of FIG. 1. FIG. 2*b* is a view of a region 107*a* of earth bit 100, as shown in FIG. 2*a*. Earth bit 100 includes several earth bit components assembled together. In this embodiment, these components include lugs 102 and cutting cones 103, wherein earth bit 100 includes three cutting cones and corresponding lugs so that earth bit 100 is a tri-cone earth bit. As shown in FIG. 2*a*, cutting cone 103 is rotatably mounted to a corresponding lug 102 with a journal 108. Journal 108 includes roller bearings 111 and ball bearings 110, which rotatably engage cutting cone 103. In operation, lug 102 rotates in response to the rotation of earth bit 100 and cutting cone 103 rotates about journal 108 in response to contacting earthen annulus.

Earth bit 100 generally includes one or more sealing members to retain lubricant between cutting cone 103 and journal 108, and to restrict the flow of abrasive material to ball bearings 110 and roller bearings 111. The lubricant is used to reduce the friction between cutting cone 103 and journal 108, as well as to reduce the friction between roller bearings 111 and ball bearings 110 and the components they engage, such as cutting cone 103 and journal 108. The sealing member(s) can be of many different types, such as 0-ring seals, and generally include an elastomeric material, such as rubber and plastic.

In this embodiment, a sealing member 112 is statically engaged with cutting cone 103 and, in accordance with the invention, dynamically engaged with a wear ring 105. In this embodiment, cutting cone 103 includes a groove 113 through which sealing member 112 extends. In this embodiment, groove 113 includes a radial surface 114 and opposed axial surfaces 115*a* and 115*b*. Sealing member 112 is statically engaged with cutting cone 103 in groove 113. In particular, sealing member 112 is statically engaged with radial surface 114. Wear ring 105 forms a dynamic seal with sealing member 112 and a static seal with lug 102 so that the rotation between lug 102 and wear ring 105 is driven to zero. It should be noted, however, that lug 102 and wear ring 105 can rotate relative to each other in some embodiments. It should be noted that two earth bit components are dynamically engaged together when they are engaged together and rotate relative to each other. A dynamic seal is formed when two earth bit components are dynamically engaged together and a seal is formed therebetween. Further, two earth bit components are statically engaged together when they are engaged together and do not rotate relative to each other. A static seal is formed when two earth bit components are statically engaged together and a seal is formed therebetween.

It should be also noted that wear ring 105 can include many different types of materials, such as boronized steel and tungsten carbide coated with titanium nitride. In general, the material included with wear ring 105 is chosen to be harder than the material included with lug 102 and sealing member 112.

Wear ring 105 can be positioned at many different locations with earth bit 100. In this embodiment, wear ring 105 is positioned so it extends proximate to an interface 109 between lug 102 and cutting cone 103 (FIG. 2*a*). It should be noted that in some embodiments, wear ring 105 is positioned so it extends proximate to an interface between cutting cone 103 and journal 108. Wear ring 105 can also be positioned to form a seal between cutting cone 103 and both lug 102 and journal 108.

In operation, lug 102 rotates in response to the rotation of earth bit 100. Cutting cone 103 rotates about journal 108 and roller bearings 110 and ball bearings 111 in response to contacting earthen annulus. Sealing member 112 rotates with cutting cone 103 and journal 108, respectively, and retains lubricant therebetween as described above. Wear ring 105 rotates with lug 102 and restricts the flow of abrasive material, such as earthen annulus, to sealing member 112. Further, sealing member 112 rotates relative to wear ring 105 and is slidingly engaged therewith. Sealing member 112 is slidingly engaged with a smooth surface of wear ring 105 to reduce the amount of wear it experiences when it rotates with cutting cone 103. In this way, wear ring 105 reduces the amount of wear that sealing member 112 experiences at its mating surface. The mating surface of sealing member 112 is its surface that engages another earth bit component, such as the cutting cone and wear ring.

It should be noted that in some embodiments, wear ring 105 can be engaged with lug 102 and cutting cone 103, wherein earth bit 100 does not include a sealing member positioned so it engages seal ring 105. In these embodiments, earth bit 100 does not generally retain lubricant in a lubricant chamber. However, wear ring 105 operates as a friction member which allows cutting cone 103 to rotate relative to lug 102 with a reduced amount of friction. Further, wear ring 105 reduces the amount of wear experienced by cutting cone 103 and lug 102 because it includes a material that is more resistant to abrasion.

Wear ring 105 can operate as a friction member in many different ways, such as by having surface 126 and sidewall 128 be friction resistant surfaces. Further, surface 125 can be a friction resistant surface, wherein surface 125 engages cutting cone 103. In this way, wear ring 105 includes a friction resistant surface which faces cutting cone 103 or lug 102. A friction resistant surface is generally one that has been smoothed to reduce its surface roughness. A surface can be smoothed in many different ways, such as by polishing.

It should be noted that wear ring 105 can experience an undesirable rotational force in response to the rotation of sealing member 112 because they are dynamically engaged together. This rotational force can undesirably break the dynamic seal between wear ring 105 and sealing member 112 and the static seal between wear ring 105 and lug 102. Breaking the dynamic seal between wear ring 105 and sealing member 112 increases the likelihood of abrasive material undesirably flowing through interface 109 to sealing member 112. Further, breaking the static seal between wear ring 105 and lug 102 can undesirably allow wear ring 105 to rotate relative to lug 102. As will be discussed in more detail presently, it is desirable to restrict the rotation of wear ring 105 relative to lug 102 so that wear ring 105 opposes the rotational force of sealing member 112.

Figure 3B:
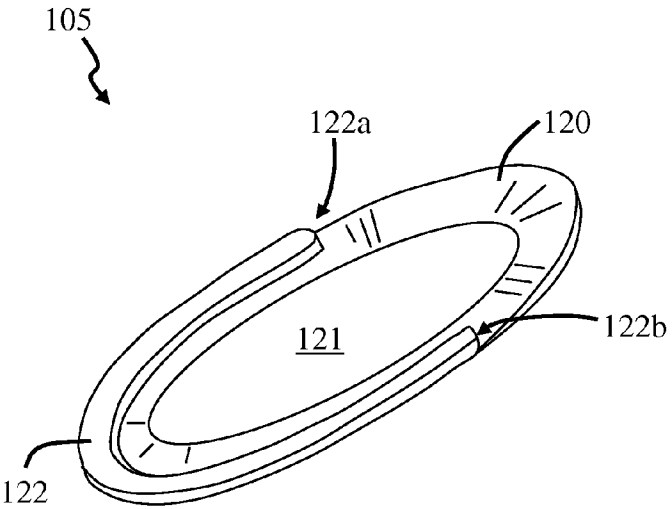
FIGS. 3*a* and 3*b* are top and perspective views, respectively, of the wear ring of FIG. 2*b*, in accordance with the invention.
Figure 3A:
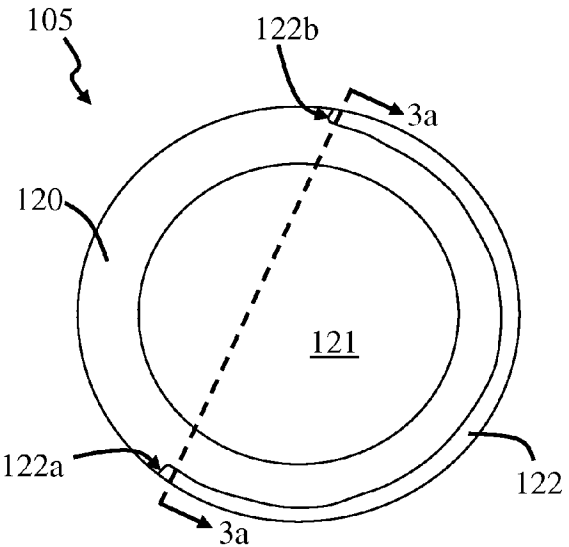
Figure 3D:
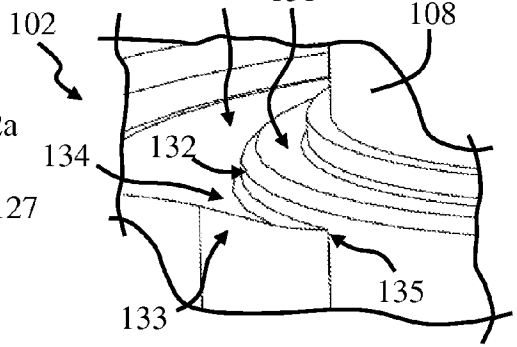
FIG. 3*d* is a perspective view of the lug of FIG. 2*a* having a sidewall for engaging the upwardly extending lip of the wear ring of FIG. 3*a*.
Figure 3C:
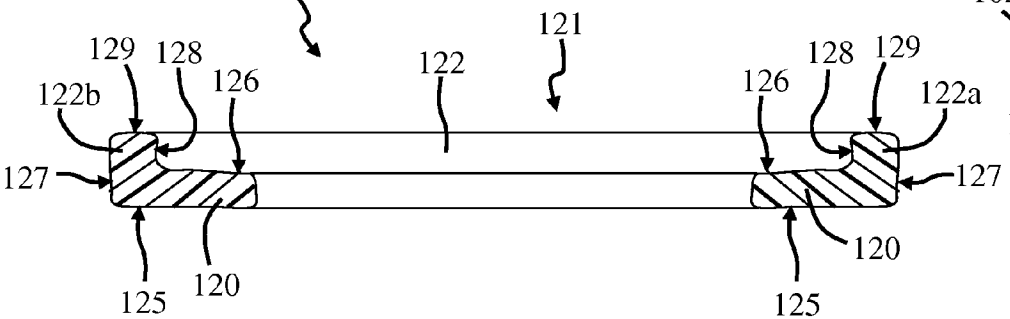
FIG. 3*c* is a cut-away view of the wear ring of FIG. 3*a* taken along a cut-line 3*a*-3*a*.

FIG. 2*b* will now be discussed in more detail with reference to FIGS. 3*a*, 3*b* and 3*c*, wherein FIGS. 3*a* and 3*b* are top and perspective views, respectively, of wear ring 105, and FIG. 3*c* is a cut-away view of wear ring 105 taken along a cut-line 3*a*-3*a* of FIG. 3*a*. In this embodiment, wear ring 105 includes an annular ring portion 120 with opposed surfaces 125 and 126 and a central opening 121. As shown in FIG. 2*b*, surface 125 engages sealing member 112 and surface 126 engages lug 102. Hence, surface 125 is a smoothed surface so there is less friction between it and sealing member 112. Central opening 121 is shaped and dimensioned so that journal 108 can extend therethrough when wear ring 105 is carried by lug 102.

In accordance with the invention, wear ring 105 includes an axially extending lip 122 which extends away from surface 126. In this way, wear ring 105 is not flush with lug 102. Axially extending lip 122 includes axial sidewalls 127 and 128 which extend perpendicular to radial surfaces 125 and 126 (FIG. 2*b*), and a radial surface 129 which extends between axial sidewalls 127 and 128. However, it should be noted that axial sidewalls 127 and 128 can extend at a non-perpendicular angle relative to radial surfaces 125 and/or 126 so that axially extending lip 122 is tapered. Axial 128 engages an axial surface 116 of lug 102 that is perpendicular to an radial surface 117 of lug 102 that engages radial surface 126. In general, radial surface 126 and axial sidewall 128 are chosen to conform with the shape of lug 102 so that a static seal is formed between them. Further, axial sidewall 127 is positioned so it faces abrasive material flowing towards interface 109 and sealing member 112. In this way, wear ring 105 restricts the flow of abrasive material to interface 109 and sealing member 112.

In this embodiment, axially extending lip 122 extends partially around annular ring portion 120 and has end portions 122*a* and 122*b*, wherein end portions 122*a* and 122*b* engage lug 102 in response to rotation of cutting cone 103. In this way, lug 102 and wear ring 105 are frictionally engaged together and lug 102 restricts the rotation of wear ring 105. End portions 122*a*and 122*b* can engage lug 102 in many different ways, one of which will be discussed in more detail presently.

FIG. 3*d* is a perspective view of lug 102 proximate to region 107*a* of FIG. 2*a*. In this embodiment, lug 102 includes surfaces 130 and 131 which engage upper surface 129 and surface 126 (FIG. 3*c*), respectively, of wear ring 105. Further, a sidewall 132 of lug 102 extends between surfaces 130 and 131 and engages sidewall 128 of wear ring 105.

In accordance with the invention, lug 102 includes a channel 134 which extends partially and annularly around lug 102. Channel 134 is shaped and dimensioned to receive lip 122. An end 135 of channel 134 is bounded by surface 130, sidewall 132 and an opposed sidewall 133.

In operation, wear ring 105 is positioned around journal 108 and moved towards lug 102 so that lip 122 is received by channel 134. Surfaces 130 and 131 engage upper surface 129 and surface 126, respectively, when lip 122 is received by channel 124. Further, sidewall 128 engages sidewall 132. End 122*a* is positioned so it faces end 135 of channel 134. End 122*a* engages end 135 in response to the rotation of wear ring 105 so that the rotation of wear ring 105 is restricted. In this way, lug 102 and wear ring 105 are frictionally engaged together and lug 102 restricts the rotation of wear ring 105 in response to the rotation of sealing member 112. It should be noted that lug 102 can restrict the rotation of wear ring 105 in many other ways, one of which will be discussed in more detail below with FIGS. 4*a* and 4*b*.

In some embodiments, earth bit 100 includes inserts 104, as shown in FIG. 1. Inserts 104 can be positioned at many different positions on earth bit 100, but they are generally positioned to reduce the amount of wear it experiences when boring a hole. In this embodiment, inserts 104 are positioned flush with or extending through an outer surface 106 of lug 102 (FIGS. 1, 2*a*, 2*c*). In this way, inserts 104 are carried by lug 102 and decrease the amount of wear it experiences when contacting abrasive material, such as earthen annulus. It should be noted that inserts 104 can include many different materials, such as tungsten carbide, wherein the material is generally harder than the material included with lug 102.

The proximity of inserts 104 to interface 109 depends on the size of the inserts and the shape of lug 102, journal 108, and cone 103. For example, lug 102 includes a lip 136 located between inserts 104 and interface 109, as shown in FIG. 1. Lip 136 can experience wear when it contacts abrasive material, so it is desirable to restrict the flow of abrasive material to it. In some embodiments, the wear ring extends outwardly from interface 109 and along outer surface 106 so it covers lip 136. One such embodiment will be discussed in more detail presently.

FIG. 2*c* is a view of a region 107*b* of earth bit 100, as shown in FIG. 2*a*. In this embodiment, earth bit 100 includes a wear ring, denoted as wear ring 105*a*, which includes annular ring 120 and axially extending lip 122, discussed above in FIG. 2*b*. In accordance with the invention, wear ring 105*a* includes an inwardly extending lip 123 which extends from axially extending lip 122 so it extends along outer surface 106 and covers lip 136. In this way, a portion of wear ring 105*a* extends along an outer surface of lug 102. In this particular embodiment, axially extending lip 122 extends proximate to insert 104. As mentioned above, insert 104 is positioned so it extends through outer surface 106 of lug 102.

It should be noted that in some embodiments, wear ring 105 can rotate relative to lug 102 so that inwardly extending lip 123 moves relative to lip 136. For example, wear ring 105 can rotate relative to lug 102 in response to the rotation of sealing member 112 and cutting cone 103. In this way, the portion of wear ring 105 that is exposed externally to earth bit 100 changes in response to the rotation of wear ring 105.

Figure 4A:
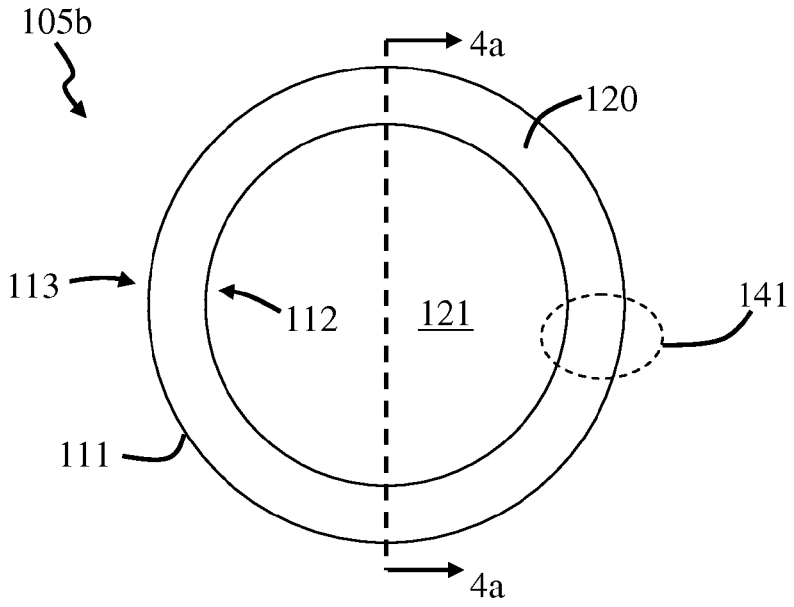
FIG. 4*a* is a top view of another embodiment of a wear ring with a flat, in accordance with the invention.
Figure 4C:
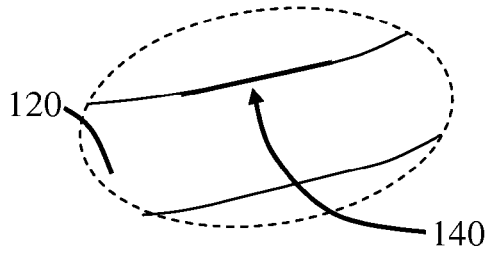
FIG. 4*c* is a close-up view of a region of FIG. 4*a* showing a flat of the wear ring.
Figure 4B:
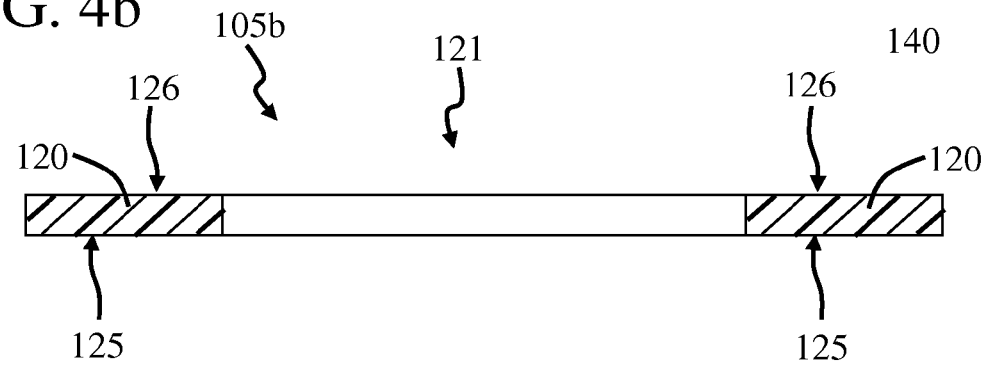
FIG. 4*b* is a cut-away side view of the wear ring of FIG. 4*a* taken along a cut-line 4*a*-4*a*.

FIG. 4*a* is a top view of another embodiment of a wear ring, denoted as wear ring 105*b*, which can replace wear ring 105. FIG. 4*b* is a cut-away side view of wear ring 105*b* taken along a cut-line 4*a*-4*a* of FIG. 4*a*. In this embodiment, wear ring 105*b* includes annular ring portion 120 with opposed sidewalls 125 and 126 and central opening 121. In accordance with the invention, wear ring 105*b* includes a flat 140 which engages lug 102 in response to the rotation of sealing member 112. Flat 140 is shown in more detail in FIG. 4*c*, which is a close-up view of a region 141 of FIG. 4*a*. Flat 140 is a portion of annular ring portion 120 that has a different curvature than the other portions. In this particular embodiment, flat 140 has a smaller curvature than the other portions of annular ring portion 120. Flat 140 engages a corresponding flat (not shown) included with lug 102. In this way, the rotation of wear ring 105*b* about lug 102 is restricted with a flat.

It should be noted that wear ring 105 can be engaged with lug 102 in many other ways so its rotation is restricted. For example, one of lug 102 or cutting cone 103*a* can carry a notch and the other can carry a pin. The notch and pin can engage each other in response to rotation of sealing member 112.

Figure 2D:
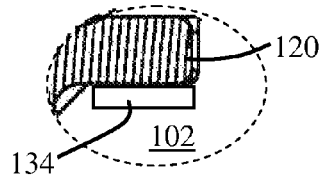
FIG. 2*d* is a side view of a static sealing member positioned on the wear ring of FIG. 2*b*.
Figure 2C:
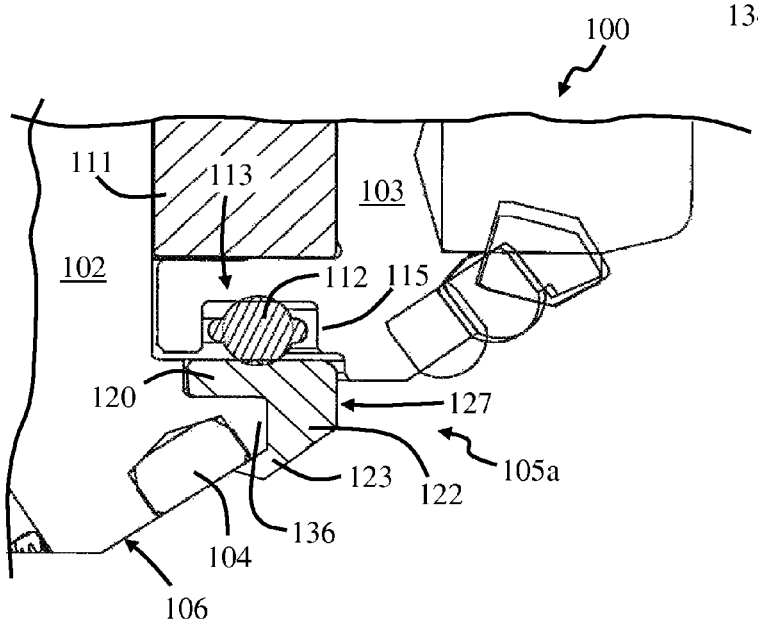
FIG. 2*c* is a close-up view of the cutting cone and journal of FIG. 2*a* with a wear ring having upwardly and inwardly extending lips, in accordance with the invention.

In another embodiment, a static sealing member 134 is positioned between surface 126 and lug 102, as shown in a side view of annular ring portion 120 and lug 102 in FIG. 2*d*. Static sealing member 134 can be of many different types, such as an adhesive, wherein the adhesive is positioned on surface 126 so that wear ring 105 is adhered to lug 102. In some embodiments, static sealing member 134 extends along sidewalls 126 and 127 of wear ring 105. In general, static sealing member 134 is chosen so that the friction between static sealing member 134 and surface 126 is greater than the friction between surface 125 and seal 112. In this way, static sealing member 134 restricts the rotation of wear ring 105 about lug 102.

In other embodiments, wear ring 105 is engaged with lug 102 with a press fit so that lug 102 restricts the rotation of wear ring 105. When wear ring 105 is press fit with lug 102, they are frictionally engaged together. For example, lip 122 of wear ring 105 can be sized so that sidewall 128 frictionally engages surface 130 on lug 102 (FIGS. 2*b* and 3*d*).

Figure 5:
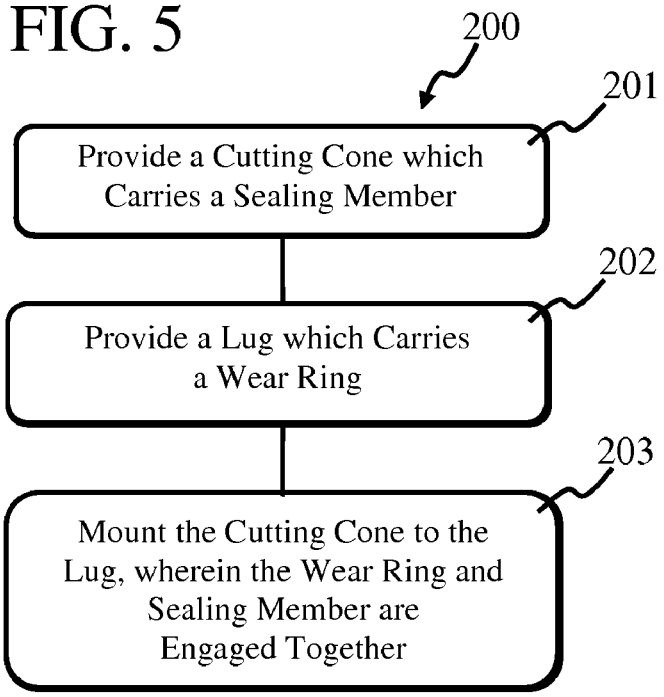
FIGS. 5 and 6 are flow diagrams of methods of assembling an earth bit, in accordance with the invention.

FIG. 5 is a flow diagram of a method 200 of assembling an earth bit, in accordance with the invention. In this embodiment, method 200 includes a step 201 of providing a cutting cone which carries a sealing member and a step 202 of providing a lug which carries a wear ring. In step 201, the sealing member is statically engaged with the cutting cone so there is a static seal between them. In step 202, the wear ring is statically engaged with the lug so there is a static seal between them. In one embodiment, the lug and wear ring are frictionally engaged together so the lug restricts the rotation of the wear ring. It should be noted that the sealing member can be statically engaged with the cutting cone by the user or they can be provided statically engaged together. Further, it should be noted that the wear ring can be statically engaged with the lug by the user or they can be provided statically engaged together.

In accordance with the invention, method 200 includes a step 203 of mounting the cutting cone to the lug, wherein the wear ring and sealing member are engaged together. In this way, the sealing member is statically engaged with the cutting cone and dynamically engaged with the wear ring. Further, the wear ring is statically engaged with the lug and dynamically engaged with the sealing member. It should be noted that the cutting cone is generally mounted to the lug with a journal. The sealing member retains lubricant between the cutting cone and journal. Further, the wear ring restricts the flow of abrasive material to the sealing member and the interface between the cutting cone and journal.

In one embodiment, the wear ring includes a smooth surface which engages the sealing member, wherein the smooth surface reduces the amount of friction the sealing member experiences when rotating relative to the wear ring. These features are useful because abrasive material and friction can undesirably wear down the sealing member.

It should be noted that method 200 can include many other steps. In some embodiments of method 200, the wear ring includes an annular base and an axially extending lip. The axially extending lip is positioned to engage the lug in response to rotation of the wear ring. Hence, the engagement between the lug and axially extending lip restricts the rotation of the wear ring. In some embodiments, the wear ring includes an inwardly extending lip which extends along an outer surface of the lug. The inwardly extending lip restricts the contact of the outer surface of the lug with abrasive material, such as earthen annulus. In one embodiment, the inwardly extending lip extends from the axially extending lip and covers an edge of the lug.

Figure 6:
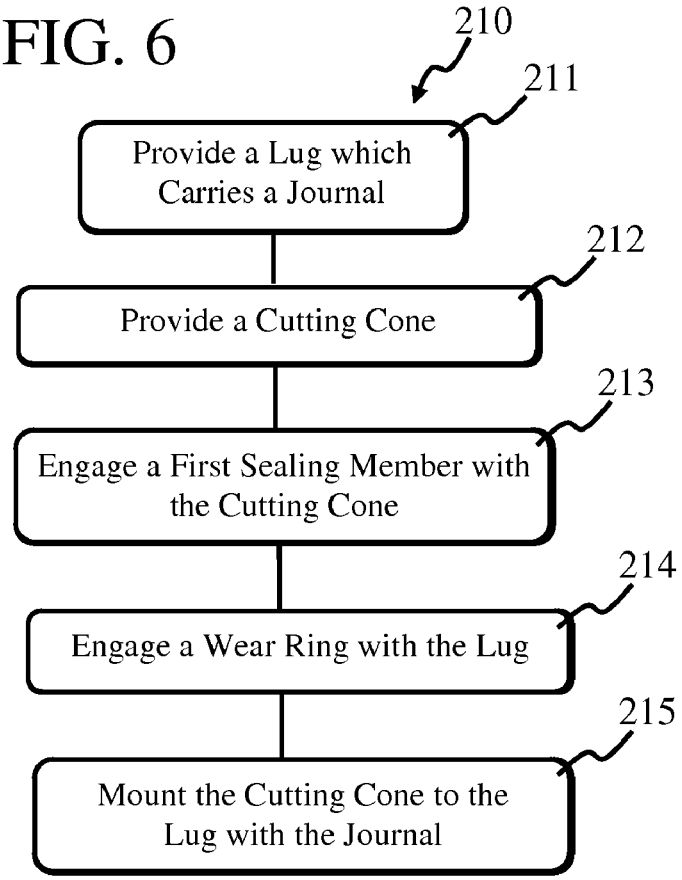

FIG. 6 is a flow diagram of a method 210 of assembling an earth bit, in accordance with the invention. In this embodiment, method 210 includes a step 211 of providing a lug which carries a journal and a step 212 of providing a cutting cone. Method 210 includes a step 213 of engaging a sealing member with the cutting cone. In accordance with the invention, method 210 includes a step 214 of engaging a wear ring with the lug. In some embodiments, the lug and wear ring are statically engaged together so the lug restricts the rotation of the wear ring. In other embodiments, the lug and wear ring are dynamically engaged together so the lug does not restrict the rotation of the wear ring.

Method 210 includes a step 215 of mounting the cutting cone to the lug with the journal. The cutting cone is mounted to the lug so the first sealing member is engaged with the wear ring. In this way, the first sealing member is statically engaged with the cutting cone and dynamically engaged with the wear ring. Further, the wear ring is statically engaged with the lug and dynamically engaged with the sealing member. The first sealing member retains lubricant between the cutting cone and journal and the wear ring restricts the flow of abrasive material to the first sealing member. The wear ring includes a smooth surface which engages the first sealing member. The smooth surface reduces the amount of wear the first sealing member experiences when rotating relative to the wear ring. These features are useful because abrasive material and friction can undesirably wear down the sealing member.

In some embodiments, method 210 includes a step of positioning a second sealing member so it retains lubricant between the cutting cone and journal. In one embodiment, the second sealing member is carried by the journal so it forms a seal between the journal and cutting cone. In this embodiment, the second sealing member is statically engaged with the journal and dynamically engaged with the cutting cone.

While particular embodiments of the invention have been shown and described, numerous variations and alternate embodiments will occur to those skilled in the art. Accordingly, it is intended that the invention be limited only in terms of the appended claims.

The invention claimed is:

1. An earth bit, comprising:

a cutting cone carried by a lug, wherein the lug includes a journal and an elongated channel proximate to the journal;

a sealing member statically engaged with the cutting cone; and a wear ring carried by the lug, the wear ring being dynamically engaged with the sealing member, wherein a portion of the wear ring extends through the elongated channel;

wherein an end of the elongated channel restricts rotation of the wear ring in response to rotation of the sealing member.

2. The earth bit of claim 1, wherein the portion of the wear ring engages the lug in the channel in response to rotation of the cutting cone.

3. The earth bit of claim 1, wherein the wear ring restricts the flow of abrasive material to the sealing member.

4. The earth bit of claim 1, wherein the wear ring includes an annular base and an axially extending elongated lip, wherein the axially extending elongated lip is the portion of the wear ring which extends through the elongated channel.

5. The earth bit of claim 1, wherein a portion of the wear ring extends along an outer surface of the lug.

6. The earth bit of claim 1, wherein the wear ring is dynamically engaged with the lug.

7. The earth bit of claim 1, wherein the wear ring includes a material that is harder than the material of the sealing member.

8. The earth bit of claim 1, wherein the sealing member extends through a groove of the cutting cone, and the wear ring covers the groove.

9. The earth bit of claim 1, wherein the sealing member is an O-ring seal.

10. The earth bit of claim 1, wherein the sealing member is an O-ring seal positioned in a groove of the cutting cone.

11. The earth bit of claim 1, wherein the lug includes a lip, and a portion of the wear ring covers the lip.

12. The earth bit of claim 1, wherein the lug includes an insert, and a portion of the wear ring extends proximate to the insert.

13. An earth bit, comprising:

a cutting cone rotatably mounted to a lug with a journal, wherein the lug includes an elongated channel which extends annularly around the journal;

a sealing member sealingly engaged with the cutting cone; and a wear ring carried by the lug, the wear ring being dynamically engaged with the sealing member and statically engaged with the lug;

wherein the wear ring includes an axially extending elongated lip which extends through the elongated channel;

wherein the axially extending lip engages the lug in response to rotation of the sealing member.

14. The earth bit of claim 13, wherein the wear ring includes an annular base, and the axially extending lip extends from the annular base away from the sealing member.

15. The earth bit of claim 14, wherein the channel includes a sidewall which engages an end of the axially extending lip in response to rotation of the sealing member.

16. The earth bit of claim 13, further including an adhesive which adheres the wear ring to the lug.

17. The earth bit of claim 13, wherein the wear ring includes a rigid material and the sealing member includes an elastomeric material.

18. The earth bit of claim 13, wherein the cutting cone includes a groove, and the sealing member extends through the groove.

19. The earth bit of claim 18, wherein the wear ring includes a radial surface which faces the groove and engages the sealing member.

20. The earth bit of claim 13, wherein the axially extending lip restricts the flow of abrasive material to the sealing member.

21. The earth bit of claim 13, wherein the wear ring includes an outer axial sidewall which extends away from the lug.

22. A method of assembling an earth bit, comprising:

providing a lug which carries a wear ring, wherein the wear ring includes an axially extending elongated lip which extends through an elongated channel of the lug;

providing a cutting cone which carries a sealing member; and mounting the cutting cone to the lug, the wear ring being positioned to engage the sealing member;

wherein the axially extending elongated lip engages an end of the elongated channel in response to rotation of the sealing member.

23. The method of claim 22, further including coupling the wear ring with the lug so the axially extending lip extends through the channel.

24. The method of claim 22, further including-slidingly engaging the wear ring with the sealing member and engaging the axially extending lip with the lug through the channel.

25. The method of claim 22, further including coupling the wear ring with the lug so a portion of it extends along an outer surface of the lug.

26. The method of claim 22, wherein the axially extending lip engages the lug in response to rotation of the sealing member.

27. The method of claim 22, wherein the wear ring includes a material that is harder than the material of the sealing member.

28. The method of claim 22, further including positioning the wear ring so it covers a lip of the lug.

29. The method of claim 22, further including positioning the wear ring so it extends proximate to an insert of the lug.

30. An earth bit, comprising:

a lug;

a cutting cone; and a wear ring which engages the cutting cone and lug, the wear ring including a friction resistant surface which faces the cutting cone, and an axially extending elongated lip which extends through an elongated channel of the lug, wherein the axially extending elongated lip engages the lug in response to rotation of the cutting cone.

31. The earth bit of claim 30, further including a sealing member statically engaged with the cutting cone.

32. The earth bit of claim 31, wherein the cutting cone includes a groove, and the sealing member extends through the groove.

33. The earth bit of claim 31, wherein the wear ring includes a material that is harder than the material of the sealing member.

34. An earth bit, comprising:

a cutting cone carried by a lug;

a sealing member which extends through a groove of the cutting cone, the sealing member being statically engaged with the cutting cone; and a wear ring which covers the groove and includes an axially extending elongated lip which extends through an elongated channel of the lug, wherein the axially extending elongated lip engages the lug in the channel in response to rotation of the sealing member.

35. The earth bit of claim 34, wherein the groove includes opposed axial sidewalls of the cutting cone.

36. The earth bit of claim 34, wherein the groove includes opposed sidewalls of the cutting cone.

37. The earth bit of claim 36, wherein the wear ring is dynamically engaged with the sealing member at a radial surface which faces the groove and extends between the opposed sidewalls.

38. An earth bit, comprising:

a cutting cone carried by a lug, wherein the lug includes an elongated channel with a sidewall;

a sealing member sealingly engaged with the cutting cone; and a wear ring carried by the lug, the wear ring being dynamically engaged with the sealing member and statically engaged with the lug;

wherein an elongated portion of the wear ring extends through the channel and engages the sidewall in response to rotation of the sealing member.

39. An earth bit, comprising:

a cutting cone carried by a lug, wherein the lug includes an elongated channel;

a sealing member statically engaged with the cutting cone; and a wear ring carried by the lug, the wear ring being dynamically engaged with the sealing member;

wherein an elongated portion of the wear ring extends through the elongated channel and engages the lug in the elongated channel in response to rotation of the cutting cone.

* * * * *